US006294984B1

(12) United States Patent
Meister

(10) Patent No.: US 6,294,984 B1
(45) Date of Patent: Sep. 25, 2001

(54) AIR HORN ASSEMBLY

(76) Inventor: Tom Meister, 1917 W. Houstonia Ave., Royal Oak, MI (US) 48073

( * ) Notice: Subject to any disclaimer, the term of this patent is extended or adjusted under 35 U.S.C. 154(b) by 0 days.

(21) Appl. No.: 09/497,596

(22) Filed: Feb. 3, 2000

(51) Int. Cl.[7] ..... G08B 3/00

(52) U.S. Cl. ..... 340/404.1; 340/384.1; 116/137 R; 116/138; 116/142 FP; 116/142 R

(58) Field of Search ..... 340/404.1, 384.1; 116/137 R, 142 FP, 138, 142 R

(56) References Cited

U.S. PATENT DOCUMENTS

| | | | | |
|---|---|---|---|---|
| D. 138,406 | | 8/1944 | Hadley | D71/1 |
| D. 322,585 | | 12/1991 | Moran | D10/120 |
| D. 323,128 | | 1/1992 | Moran | D10/120 |
| 3,066,641 | | 12/1962 | Buell, Jr. et al. | 116/112 |
| 3,503,363 | | 3/1970 | Jacoby | 116/106 |
| 4,185,670 | * | 1/1980 | Sartell, Jr. | 141/91 |
| 4,314,522 | | 2/1982 | Frigo | 116/142 R |
| 4,829,930 | | 5/1989 | Fischer et al. | 116/142 FP |
| 5,078,074 | * | 1/1992 | Gomez | 116/137 R |
| 5,355,830 | * | 10/1994 | deJong | 116/142 FP |
| 5,477,208 | | 12/1995 | Henderson et al. | 340/471 |
| 5,747,886 | | 5/1998 | Parr et al. | 307/10.2 |
| 5,782,198 | | 7/1998 | Sinclair, II et al. | 116/139 |

* cited by examiner

*Primary Examiner*—Julie Lieu
(74) *Attorney, Agent, or Firm*—Bliss McGlynn & Nolan, PC

(57) ABSTRACT

An electro-pneumatic air-horn assembly comprises a horn assembly, an electrically powered air-compressor assembly, a mounting bracket, and a rigid metal conduit. The horn assembly includes an elongated trumpet. The air-compressor assembly is adapted to provide air to the horn assembly. The mounting bracket is adapted to support the air-compressor assembly and the horn assembly and mount the air-horn assembly to a vehicle. The mounting bracket includes an upper portion operatively attached to the air-compressor assembly, a lower portion operatively attached to the horn assembly, and an elbow transition extending between the upper and lower portions. The rigid metal conduit extends between the air-compressor assembly and the horn assembly to provide fluid communication therebetween. The horn assembly, air-compressor assembly, mounting bracket, and conduit are pre-assembled and adapted to be mounted directly to the vehicle as a unit. Further, a vibration-stabilizer assembly disposed between the mounting bracket and the vehicle dampens vibrations generated by the vehicle and limits rotation of the air-horn assembly relative to the vehicle.

21 Claims, 6 Drawing Sheets

AIR HORN ASSEMBLY

BACKGROUND OF THE INVENTION

1. Field of the Invention

The present invention relates, generally, to an air-horn assembly and, more specifically, to an air-horn assembly that is adapted for use on motorcycles and the like.

2. Description of the Related Art

The motorcycle remains a popular vehicle, not only as a mode of transportation, but also as a means to facilitate a lifestyle. Clubs and social groups have been organized for the purpose of planning trips, trading information, and enhancing the enjoyment that members derive from riding their motorcycles. Harley-Davidson motorcycles enjoy particular esteem among motorcycle enthusiasts and are often the bike of choice for many who favor such activities.

As the popularity of motorcycles has increased and spread, accessories for the motorcycle, usually available through the aftermarket, have become in high demand and proliferated. Many accessories serve to add comfort and convenience and to personalize a particular bike to its owner's taste.

One such accessory is an air horn. The air horn usually includes an air compressor and a horn connected to the compressor via an air-supply line. In the case of Harley-Davidson motorcycles, for example, the stock horn is mounted on the left side of the bike, from the rider's perspective, and between the V-shaped cylinders formed in the engine block. A stock horn-cover usually shields the stock automotive- type electric horn and related components. As it happens, there has been a demand by enthusiasts for air horns having different sounds, appearance, and presentation than the standard horns provided by the manufacturer. However, the air horns known in the related art have generally suffered from a number of disadvantages that, heretofore, have limited their use among motorcycling enthusiasts despite the inherent demand for them.

More specifically, the air horns known in the related art typically employ a flimsy plastic air-supply line or tube to convey pressurized air from the compressor to the horn. Due to its proximity to the engine, the plastic tube often melts, especially if brought into contact with the engine block. This ultimately leads to premature horn failure. Further, the flimsy plastic tube provides no support for the horn.

Many air horns available in the aftermarket are also difficult to mount to the motorcycle. More specifically, some require an adjustment of a strategic crank-case stud for mounting purposes. Some require that the mounting bracket and trumpet of the horn be angled upward to clear the shift linkage of some models. The appearance of such a cobbled-up system is undesirable and negatively effects the overall appearance of the motorcycle. Furthermore, some air horns known in the related art are designed in such a way that they will not fit motorcycles with lower fairings.

Additionally, the compressor on most air horns must be removed from its mountings to perform routine maintenance, such as oiling. The trumpet throat and sound diaphragm on the air horns available in the market today are unprotected from air-borne debris, such as stones, pebbles, and road particles. In the end, the air horns currently available in the related art are merely a collection of loose parts and fasteners that the motorcyclist must adapt to fit the bike in any way he/she can.

SUMMARY OF THE INVENTION AND ADVANTAGES

The present invention overcomes the disadvantages in the related art in an electro-pneumatic air-horn assembly. The air-horn assembly comprises a horn assembly, an electrically powered air-compressor assembly, a mounting bracket, and a rigid metal conduit. The horn assembly includes an elongated trumpet. The air-compressor assembly is adapted to provide air to the horn assembly. The mounting bracket is adapted to support the air-compressor assembly and the horn assembly and mount the air-horn assembly to a vehicle. The mounting bracket includes an upper portion operatively attached to the air-compressor assembly, a lower portion operatively attached to the horn assembly, and an elbow transition extending between the upper and lower portions. The rigid metal conduit extends between the air-compressor assembly and the horn assembly to provide fluid communication therebetween. The horn assembly, air-compressor assembly, mounting bracket, and conduit are pre-assembled and adapted to be mounted directly to the vehicle as a unit.

One advantage of the present invention is that the rigid metal conduit strengthens the overall assembly and will not melt, even when juxtaposed to the engine block.

Another advantage of the present invention is that the compressor assembly is adapted to receive maintenance, such as oiling, while mounted in place on the motorcycle.

Another advantage of the present invention is that the diaphragm and throat of the trumpet of the air-horn assembly are protected by an internal screen.

Still another advantage of the present invention is that it may be easily mounted to the motorcycle. More specifically, the air-horn assembly of the present invention fits all Harley-Davidson models manufactured since 1992 having a stock horn mounted on the left side between the cylinders and fits other models with a slight addition of parts.

Still another advantage is that the air horn assembly of the present invention is an integrated unit that is supplied ready to be mounted to a motorcycle and operated.

Other objects, features, and advantages of the present invention will be readily appreciated as the same becomes better understood after reading the subsequent description taken in connection with the accompanying drawings.

DETAILED DESCRIPTION OF THE PREFERRED EMBODIMENT(S)

Figure 1:
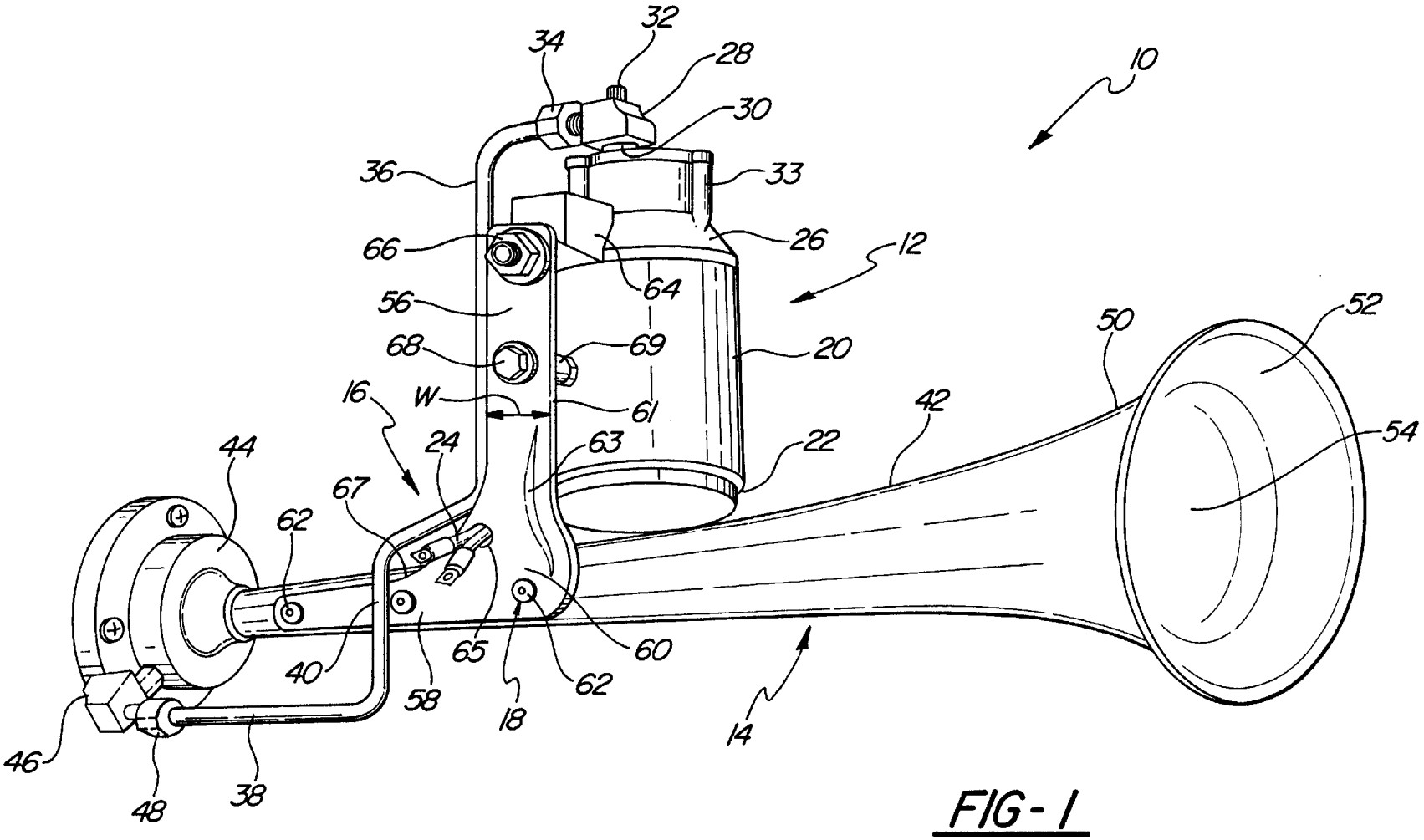
FIG. 1 is a perspective view of the air-horn assembly of the present invention taken from one side of the assembly.
Figure 2:
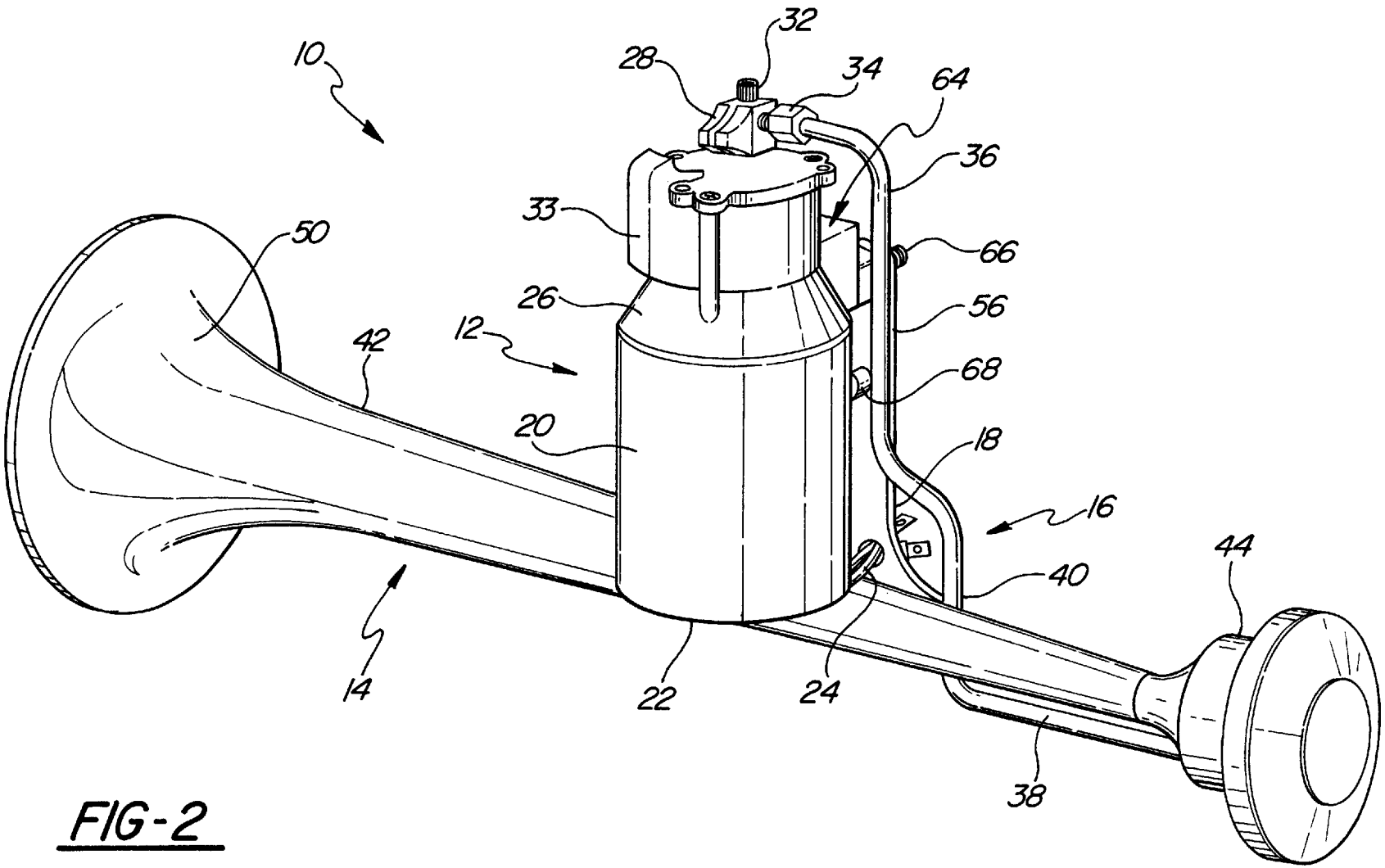
FIG. 2 is a perspective view of the air-horn assembly of the present invention taken from the opposite side of the assembly shown in FIG. 1.
Figure 3:
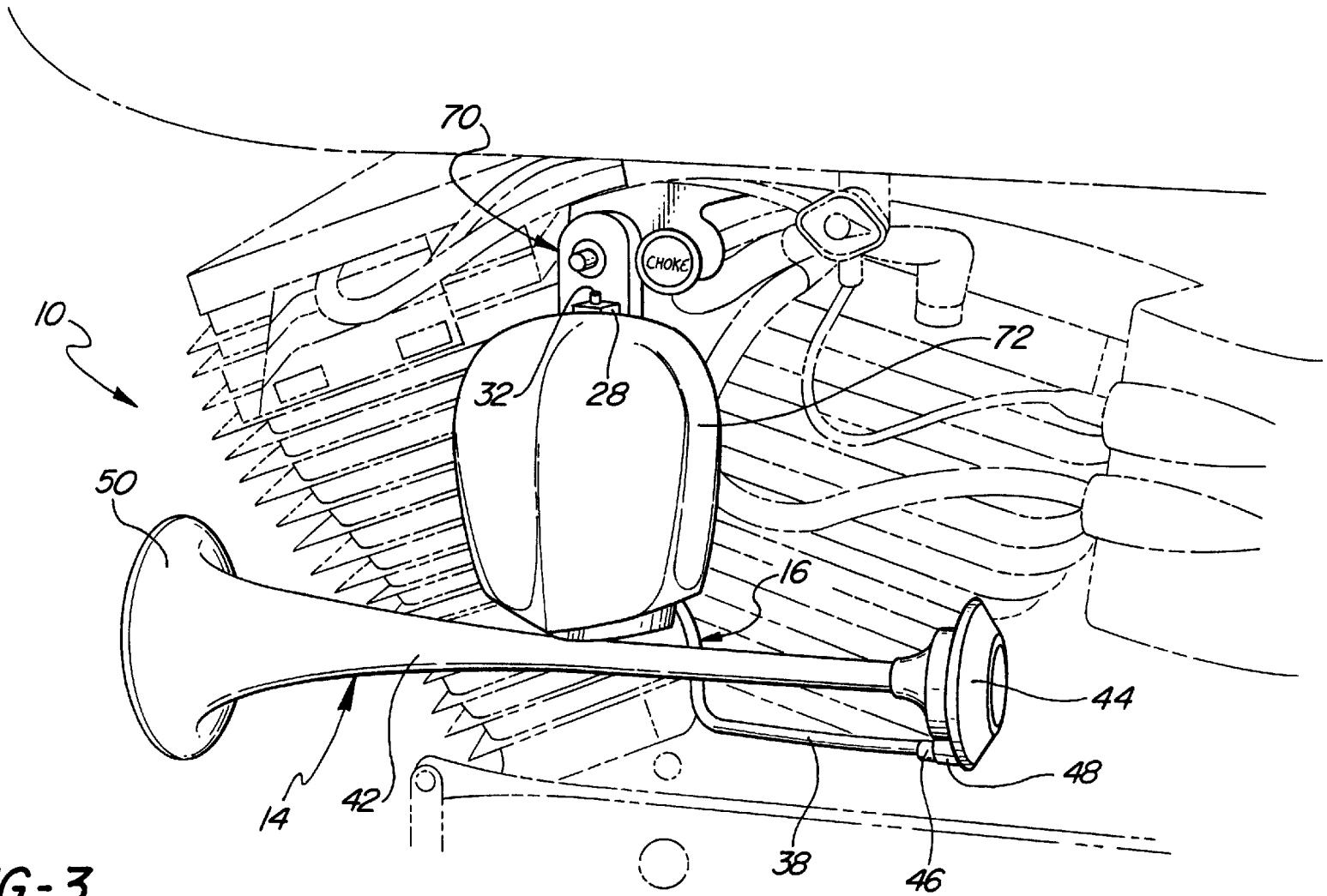
FIG. 3 is a side view of the air-horn assembly of the present invention shown mounted to a motorcycle.
Figure 4:
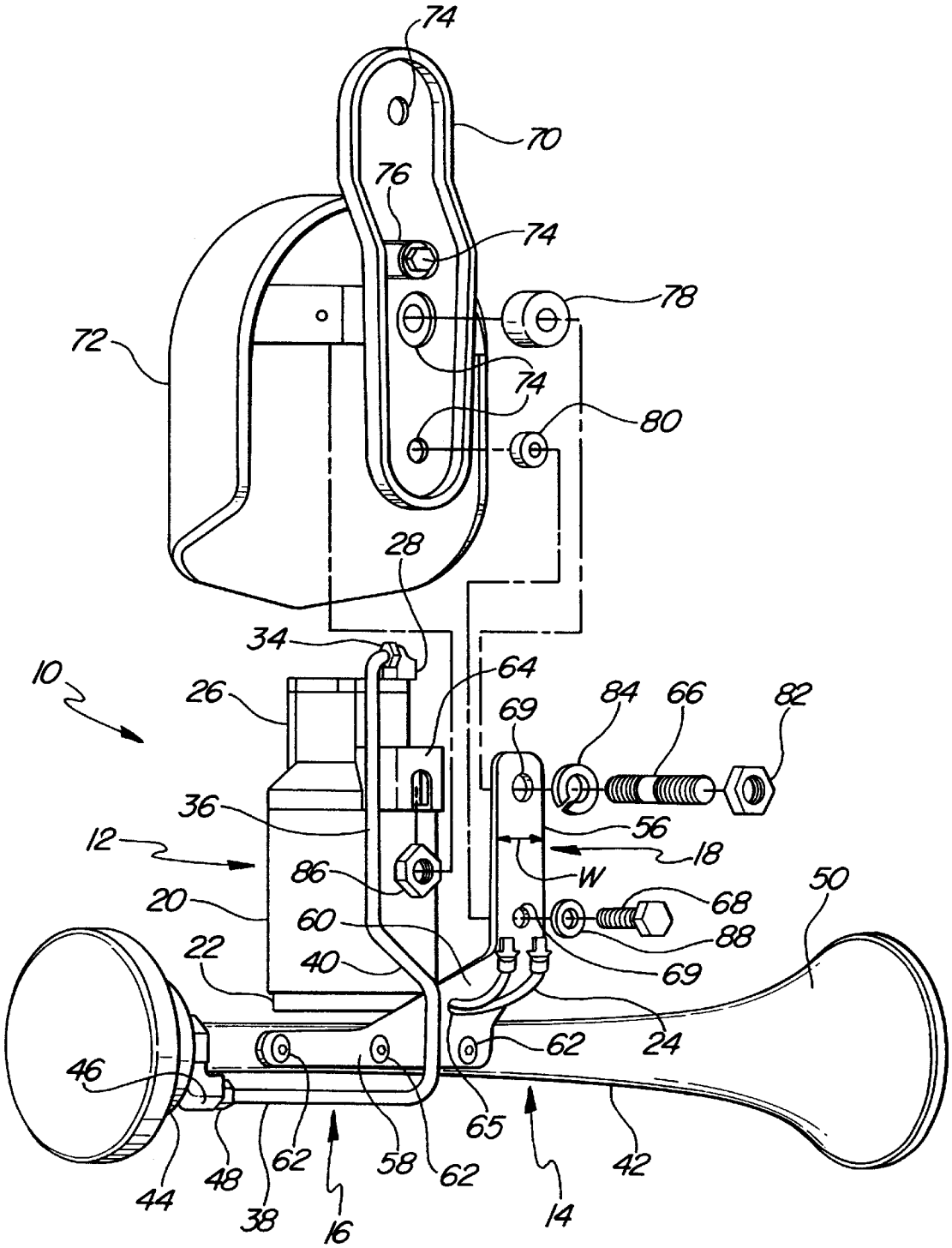
FIG. 4 is a partially exploded view of the air-horn assembly of the present invention.

An air-horn assembly of the present invention is generally indicated at 10 in FIGS. 1, 2, 3, and 4. Referring specifically to FIGS. 1, 2, and 4, the air-horn assembly includes a rotary air-compressor assembly, generally indicated at 12, a horn assembly, generally indicated at 14, a rigid metal conduit, generally indicated at 16, that extends between the rotary air-compressor assembly 12 and the horn assembly 14 to provide fluid communication therebetween. In addition, the air-horn assembly 10 includes a mounting bracket, generally indicated at 18.

The rotary air-compressor assembly 12 is adapted to provide low-volume air at low pressure to the horn assembly 14. To this end, the rotary air-compressor assembly 12 includes an electrical motor 20 having a lower-housing skirt 22. A pigtail 24 or any other electrical-connecting device is supported by and extends from the skirt 22 and is adapted for connection to a source of electrical power to drive the electrical motor 20. In turn, the electrical motor 20 drives a compressor 26 that is mounted to a top portion of the electrical motor 20. A chrome, brass, or copper, or any other aesthetically pleasing finish, elbow fitting 28 is threaded to a nipple 30 that extends from the compressor 26. The elbow fitting 28 includes a threaded screw 32 that allows access to the compressor 26 for lubricating same. An operator can merely remove the threaded screw 32 from the elbow fitting 28 and administer lubricant, such as oil, to the compressor 26, for example, every three or four months. This lubricating operation may be carried out even while the air-horn assembly 10 is mounted to a motorcycle as will be described in greater detail below. The compressor may further include a compressor-inlet shield 33 adapted to prevent water and debris from entering the inlet of the compressor 26.

A nut 34 provides a tight connection between the rigid metal conduit 16 and the elbow fitting 28. The rigid metal conduit 16 includes a vertically extending upper portion 36, a horizontally extending lower portion 38, and an intermediate portion 40 that traverses a portion of the horn assembly 14 as well as the mounting bracket 18. In the preferred embodiment, the rigid metal conduit is ¼-inch steel that has been finish-plated after it has been cut and bent. In addition to providing fluid communication between the compressor 26 and the horn assembly 14, the rigid metal conduit 16 provides a level of stability and support to the overall air-horn assembly 10.

The horn assembly 14 includes an elongated trumpet 42 and a sound unit 44 operatively mounted at a narrow end of the elongated trumpet 42. The sound unit 44 includes a diaphragm (not shown) that vibrates against an orifice to produce a sound. Vibration of the diaphragm is induced by the air provided by the rotary air-compressor assembly 12 through the rigid metal conduit 16. To that end, the sound unit 44 includes a chrome, brass, or copper, or any other aesthetically pleasing finish, elbow fitting 46 that is connected to the lower portion 38 of the rigid metal conduit 16 via a nut 48. The trumpet 42 merges into a flared portion 50 having an open end 52. A protective grill or screen 54 is supported in the flared portion 50 near the open end 52 to prevent damage to the trumpet 42 and sound unit 44 from stones, pebbles, road debris, and the like that may be caught therein.

The mounting bracket 18 includes a vertically extending upper portion 56 and a horizontally extending lower portion 58 with an elbow transition 60 between the upper and lower portions 56,58, respectively. The mounting bracket 18 also defines a perimeter and includes a lip 61 displaced about the perimeter. The upper portion 56 defines a pre-determined width (w) and a ribbed bead 63 disposed within the width (w). The elbow transition 60 includes an aperture 65 therethrough to receive the electrical-connecting device 24 and an inside corner 67 having a substantial radius of curvature.

The trumpet 42 of the horn assembly 14 is operatively supported and otherwise attached to the lower portion 58 of the mounting bracket 18 via rivets 62 at at least three equidistant points. Neoprene washers (not shown) or the like are employed around the rivets 62 between the lower portion 58 of the mounting bracket 18 and the trumpet 42 to attenuate any vibrations and noise. The rotary air-compressor assembly 12 is mounted to the upper portion 56. To that end, the compressor 26 includes a fastener housing 64 that receives a stud or a bolt 66 to mount the compressor 26 and the entire rotary air-compressor assembly 12 to the upper portion 56 of the mounting bracket 18.

Figure 5:
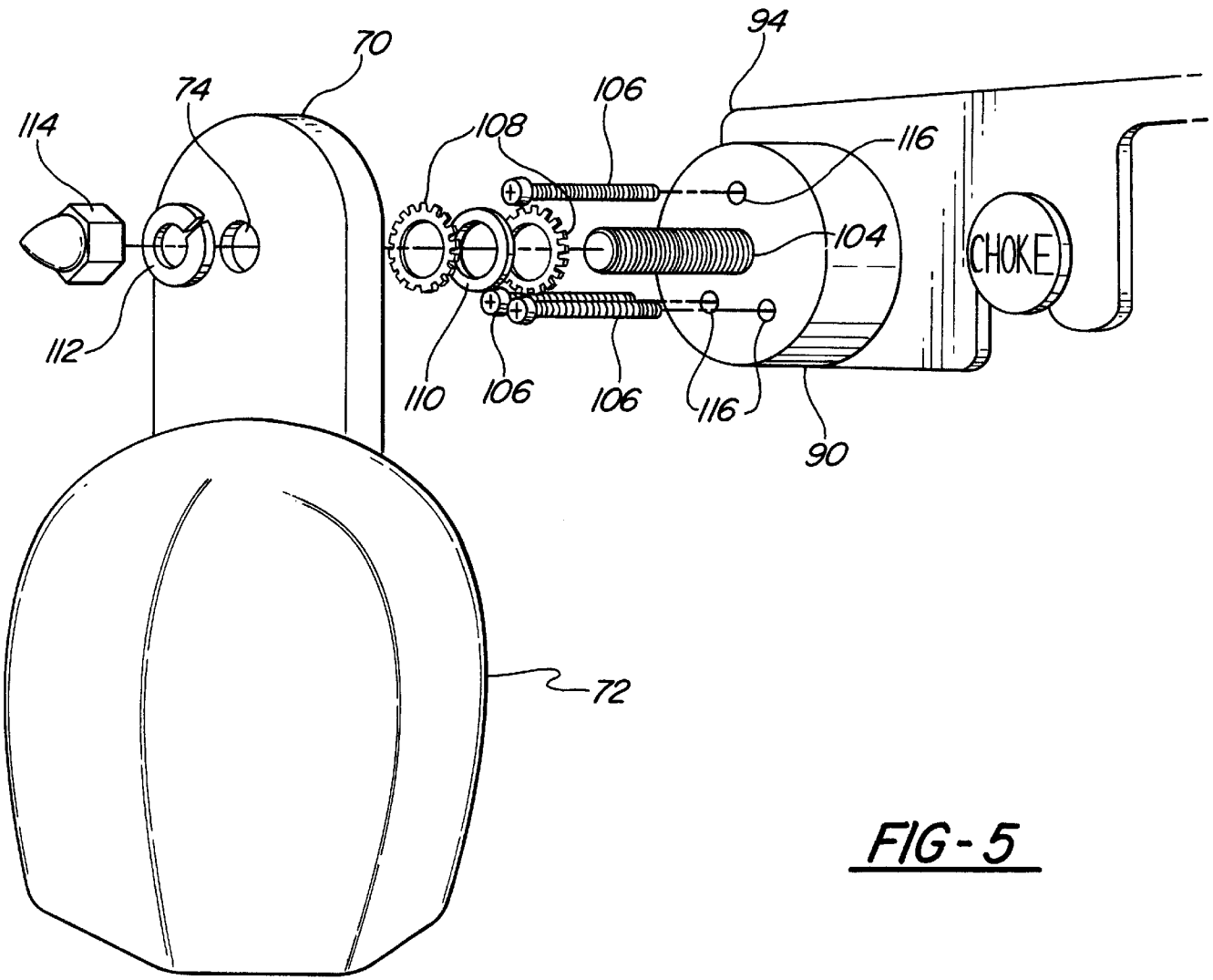
FIG. 5 is an enlarged exploded view of the fastening system employed to mount the air-horn assembly of the present invention to a vehicle.

The air-horn assembly 10 of the subject invention comes assembled substantially as shown in FIGS. 1 and 2 and is easily adapted for mounting between the V-shaped cylinders defined in the engine block of a motorcycle, as illustrated in FIG. 3. A protective cover 72 shields the rotary air-compressor assembly 12 and includes an upstanding cover bracket 70 as illustrated in FIGS. 3 through 5. The mounting bracket 18 is operatively connected to the cover bracket 70. More specifically, a standard stud or bolt arrangement 68 may be employed to further secure the mid-section of the upper portion 56 to the upstanding cover bracket 70. As such, the mounting bracket 18 may include a plurality of holes 69 completely therethrough adapted to receive the stud or bolt 66 and/or the stud or bolt arrangement 68. In addition, the cover bracket 70 includes a plurality of apertures 74 therethrough and a wire clip 76 extending therefrom opposite the protective cover 72.

As specifically illustrated in FIGS. 3 and 4, the cover bracket 70 is received between the mounting bracket 18 and the rotary air-compressor assembly 12 such that the rotary air-compressor assembly 12, the mounting bracket 18, and the upper portion 36 of the rigid metal conduit 16 are received and shielded by the protective cover 72. The stud or bolt 66 and the stud or bolt arrangement 68 are received through the corresponding holes 69 and the apertures 74 of the bracket assembly 18 and the cover bracket 70, respectively. The cover bracket 70 and the protective cover 72 are secured to the mounting bracket 18 via a combination of a large nylon spacer 78, a small nylon spacer 80, a nut 82, a split lock-washer 84, a jam-nut 86, and a flat washer 88, or any other fastening combination generally known in the art. However, when mounted as illustrated in FIG. 3, the screw 32 that allows lubricating access to the compressor 26 may be removed by an operator without removing the assembly from its mounted position.

FIG. 5 illustrates a fastening system, generally indicated at 90, that may be employed to mount and stabilize the air-horn assembly 10 to a vehicle, such as a motorcycle. Specifically, the air-horn assembly 10 further includes a vibration-stabilizer assembly, generally indicated at 92 in FIG. 6. The vibration-stabilizer assembly 92 is disposed between the mounting bracket 18 and a vehicle bracket 94 of the motorcycle for dampening vibrations generated by the vehicle and for eliminating or limiting any rotation of the air-horn assembly 10 about an axis as will be described in greater detail below. To this end, the vibration-stabilizer assembly 92 includes a front disk 96, a rear disk 98, and an isolater 100.

Figure 6:
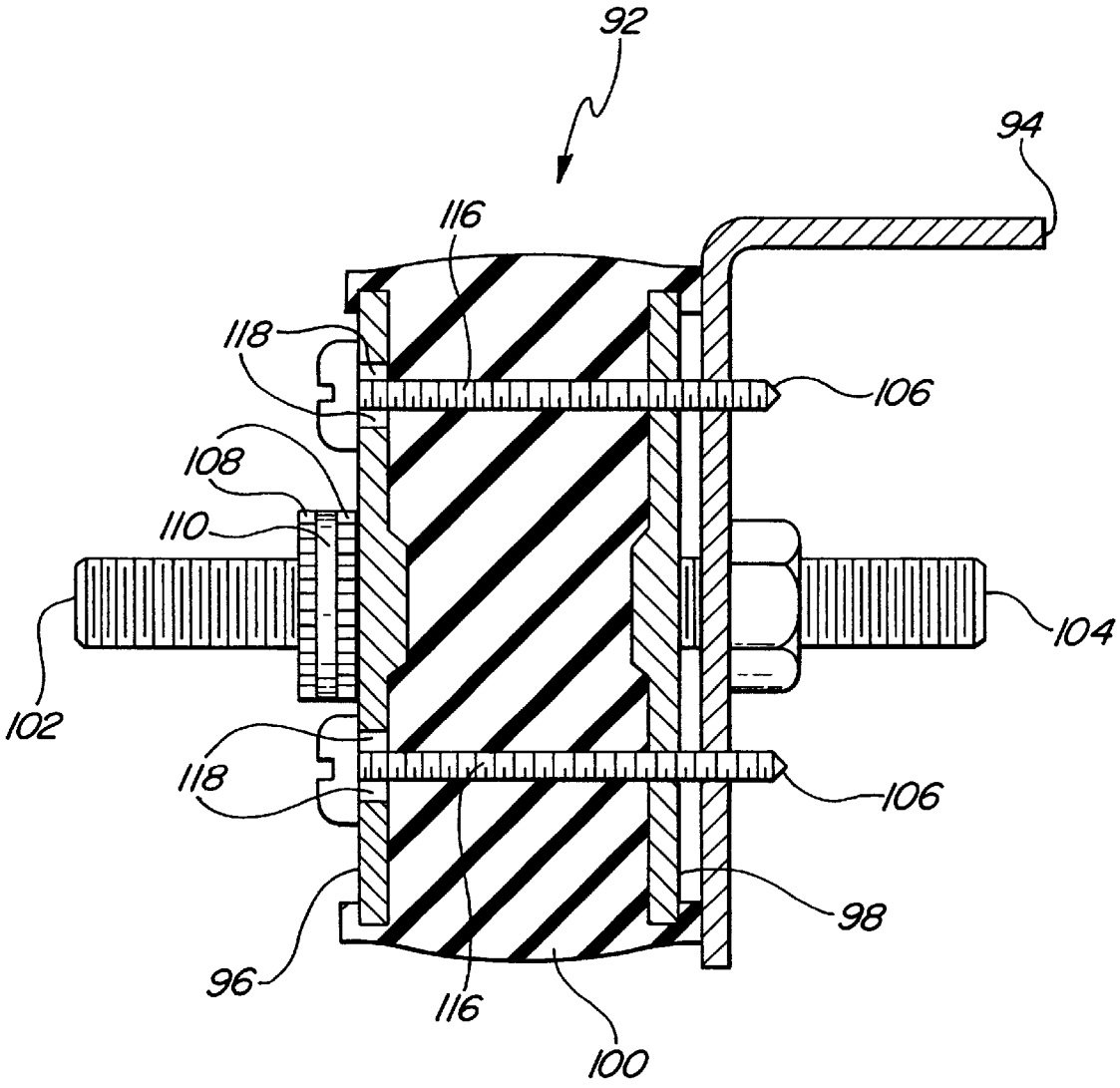
FIG. 6 is a cross-sectional side view of the vibration-stabilizer assembly of the air-horn assembly of the present invention.

As best illustrated in FIG. 6, the front disk 96 has a horn stud 102 extending outwardly therefrom by which the mounting bracket 18 is adapted to be supported. The rear disk 98 has a vehicle stud 104 extending outwardly therefrom that defines a mounting axis and that is adapted to mount the pre-assembled air horn 10 to the corresponding vehicle bracket 94. The isolator 100 is disposed between the front disk 96 and the rear disk 98. In a preferred embodiment, the isolator 100 is a neoprene rubber discoid that extends between and is bonded to the front disk 96 and the rear disk 98 for dampening vibrations from the vehicle to the air-horn assembly 10. A plurality of fasteners are spaced radially about the mounting axis and extend through the front disk 96, the isolator 100, the rear disk 98, and the corresponding vehicle bracket 94 to fix the vibration-stabilizer assembly 92 against rotation about the mounting axis. In a preferred embodiment, the plurality of fasteners include at least three screws 106 having a threaded shaft that extends through the front disk 96, the isolator 100, the rear disk 98, and the corresponding vehicle bracket 94. Furthermore, the fasteners may include two external-tooth lock-washers 108, a flat washer 110, a lock-washer 112, and an acorn nut 114, as illustrated in FIG. 5. However, as will be appreciated by a person of ordinary skill in the art, the plurality of fasteners may include any combination of like parts.

The front disk 96 and the rear disk 98 include a plurality of apertures 116 extending therethrough that correspond to the plurality of fasteners 106. The apertures 116 that extend through the front disk 96 are sized to present a relief space 118 between the fasteners 106 and the perimeter of the apertures 116 to allow limited relative movement between the front disk 96 and the fasteners 106 in a direction transverse to the mounting axis. The cover bracket 70 is operatively mounted to the vibration-stabilizer assembly 92 via the horn stud 102.

Thus, the rigid metal conduit 16 of the air-horn assembly 10 of the present invention will not melt, despite being closely juxtaposed to the engine block of the motorcycle, and further adds strength to the assembly 10. In addition, the air-horn assembly 10 of the present invention may be easily maintained and lubricated while mounted in place as shown in FIG. 3. The throat of the trumpet 42 and the diaphragm of the sound unit 44 of the air-horn assembly 10 of the present invention are protected from damage due to stones, pebbles, or other road debris by the screen 54. Furthermore, the air-horn assembly 10 of the present invention fits all Harley-Davidson models manufactured since 1992 that include a stock horn mounted on the left side between the cylinders as well as other models with the addition of a few parts. Also, the vibration-stabilizer assembly 92 disposed between the mounting bracket 18 and the vehicle dampens vibrations generated by the vehicle and limits rotation of the air-horn assembly 10 relative to the vehicle. Finally, the air-horn assembly 10 comes as an assembled unit that is ready to be mounted to the motorcycle and plugged into a source of electrical power via the pigtails 24.

The invention has been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

I claim:

1. An electro-pneumatic air-horn assembly, comprising:

a horn assembly including an elongated trumpet;

an electrically powered air-compressor assembly adapted to provide air to said horn assembly;

a mounting bracket adapted to support said air-compressor assembly and said horn assembly and to mount said air-horn assembly to a vehicle, said mounting bracket including an upper portion operatively attached to said air-compressor assembly, a lower portion operatively attached to said horn assembly, and an elbow transition extending between said upper and lower portions;

a vibration-stabilizer assembly disposed between said mounting bracket and the vehicle for dampening vibrations generated by the vehicle and for limiting rotation of said air-horn assembly relative to the vehicle; and a rigid metal conduit extending between said air-compressor assembly and said horn assembly to provide fluid communication therebetween, said horn assembly, air-compressor assembly, mounting bracket, and conduit being pre-assembled and adapted to be mounted directly to the vehicle as a unit.

2. The electro-pneumatic air-horn assembly as set forth in claim 1, wherein said horn assembly includes a sound unit, said trumpet includes a flared portion having an open end and a narrow portion, said sound unit operatively mounted to said narrow portion.

3. The electro-pneumatic air-horn assembly as set forth in claim 2, wherein said flared portion includes a protective grill supported therein near said open end.

4. The electro-pneumatic air-horn assembly as set forth in claim 1, wherein said air compressor assembly includes an electrical motor and a compressor mounted to a top portion of and driven by said electrical motor.

5. The electro-pneumatic air-horn assembly as set forth in claim 4, wherein said motor includes an electrical-connecting device supported thereby and extending therefrom and adapted for connection to a source of electrical power to drive said motor.

6. The electro-pneumatic air-horn assembly as set forth in claim 5, wherein said motor includes a cylindrical housing having a skirt disposed about one end thereof and wherein said electrical-connecting device extends from said skirt.

7. The electro-pneumatic air-horn assembly as set forth in claim 4, wherein said compressor includes a nipple and a fastener housing extending from said compressor, said nipple having an elbow fitting connected thereto and said elbow fitting having a fastener adapted to allow lubricating access to said compressor.

8. The electro-pneumatic air-horn assembly as set forth in claim 7, wherein said compressor includes a shield adapted to prevent debris from entering said compressor.

9. The electro-pneumatic air-horn assembly as set forth in claim 1, wherein said mounting bracket defines a perimeter and includes a lip displaced about said perimeter.

10. The electro-pneumatic air-horn assembly as set forth in claim 7, wherein said upper portion of said mounting bracket defines a pre-determined width and a ribbed bead disposed within said width of said mounting bracket and is mounted to said fastener housing.

11. The electro-pneumatic air-horn assembly as set forth in claim 1, wherein said lower portion of said mounting bracket is operatively attached to said horn assembly at least three equidistant points.

12. The electro-pneumatic air-horn assembly as set forth in claim 5, wherein said elbow transition of said mounting bracket includes an aperture therethrough to receive said electrical-connecting device and an inside corner having a substantial radius of curvature.

13. The electro-pneumatic air-horn assembly as set forth in claim 7, wherein said upper portion of said mounting bracket includes at least one hole adapted to receive a stud extending from said fastener housing.

14. The electro-pneumatic air-horn assembly as set forth in claim 1, wherein said conduit includes a vertically extending upper portion connected to said air-compressor assembly, a horizontally extending lower portion connected to said horn assembly, and an intermediate portion that traverses a portion of said trumpet and said lower portion of said mounting bracket.

15. The electro-pneumatic air-horn assembly as set forth in claim 1, wherein said vibration-stabilizer assembly includes a front disk having a horn stud extending outwardly therefrom with said mounting bracket adapted to be supported by said horn stud, a rear disk having a vehicle stud extending outwardly therefrom and defining a mounting axis, said vehicle stud adapted to mount said pre-assembled air horn to a corresponding vehicle bracket, an isolator disposed between said front and rear disks, and a plurality of fasteners spaced radially about said mounting axis and extending through said front disk, said isolator, said rear disk, and the corresponding vehicle bracket to fix said vibration-stabilizer assembly against rotation about said mounting axis.

16. The electro-pneumatic air-horn assembly as set forth in claim 15, wherein said isolator is a neoprene rubber discoid extending between and bonded to said front and rear disks for dampening vibrations from the vehicle to said air-horn assembly.

17. The electro-pneumatic air-horn assembly as set forth in claim 15, wherein said front and rear disks include a plurality of apertures extending therethrough and corresponding to said plurality of fasteners, said plurality of apertures extending through said front disk being sized to present a relief space between said fasteners and the perimeter of said apertures to allow limited relative movement between said front disk and said fasteners in a direction transverse to said mounting axis.

18. The electro-pneumatic air-horn assembly as set forth in claim 15, wherein said plurality of fasteners include at least three screws.

19. The electro-pneumatic air-horn assembly as set forth in claim 15, further including a protective cover adapted to shield said air-compressor assembly and including an upstanding cover bracket, said mounting bracket operatively connected to said cover bracket and said cover bracket operatively mounted to said vibration-stabilizer assembly via said horn stud.

20. An electro-pneumatic air-horn assembly, comprising:

a horn assembly including an elongated trumpet;

an electrically powered air-compressor assembly adapted to provide air to said horn assembly;

a mounting bracket adapted to support said air-compressor assembly and said horn assembly and to mount said air-horn assembly to a vehicle, said mounting bracket including an upper portion operatively attached to said air-compressor assembly, a lower portion operatively attached to said horn assembly, and an elbow transition extending between said upper and lower portions, wherein said upper portion defines a pre-determined width and a ribbed bead disposed within said width; and a rigid metal conduit extending between said air-compressor assembly and said horn assembly to provide fluid communication therebetween, said horn assembly, air-compressor assembly, mounting bracket, and conduit being pre-assembled and adapted to be mounted directly to the vehicle as a unit.

21. An electro-pneumatic air-horn assembly, comprising:

a horn assembly including an elongated trumpet;

an electrically powered air-compressor assembly adapted to provide air to said horn assembly;

a mounting bracket adapted to support said air-compressor assembly and said horn assembly and to mount said air-horn assembly to a vehicle, said mounting bracket including an upper portion operatively attached to said air-compressor assembly, a lower portion operatively attached to said horn assembly, and an elbow transition extending between said upper and lower portions, wherein said upper portion includes at least one hole adapted to receive a stud extending from said air-compressor assembly; and a rigid metal conduit extending between said air-compressor assembly and said horn assembly to provide fluid communication therebetween, said horn assembly, air-compressor assembly, mounting bracket, and conduit being pre-assembled and adapted to be mounted directly to the vehicle as a unit.

* * * * *